US006871603B2

(12) United States Patent
Maxwell

(10) Patent No.: US 6,871,603 B2
(45) Date of Patent: Mar. 29, 2005

(54) GASIFICATION SYSTEM

(75) Inventor: Ross H. Maxwell, Winnipeg (CA)

(73) Assignee: Home Farms Technologies Inc., Brandon (CA)

( * ) Notice: Subject to any disclaimer, the term of this patent is extended or adjusted under 35 U.S.C. 154(b) by 0 days.

(21) Appl. No.: 10/368,053

(22) Filed: Feb. 19, 2003

(65) Prior Publication Data

US 2003/0177963 A1 Sep. 25, 2003

Related U.S. Application Data

(60) Provisional application No. 60/366,521, filed on Mar. 25, 2002.

(51) Int. Cl.[7] ..... F23G 5/04; F23B 7/00

(52) U.S. Cl. ..... 110/229; 110/224; 110/233

(58) Field of Search ..... 110/224, 233, 110/234, 218, 221, 229, 230, 231, 115, 182.5, 110; 48/89, 111; 202/105, 100, 96

(56) References Cited

U.S. PATENT DOCUMENTS

| | | | | | |
|---|---|---|---|---|---|
| 2,147,324 | A | * | 2/1939 | Ackeren | 110/229 |
| 3,572,665 | A | * | 3/1971 | Vincent et al. | 110/185 |
| 3,670,669 | A | * | 6/1972 | Hoad | 110/220 |
| 3,794,565 | A | * | 2/1974 | Bielski et al. | 202/100 |
| 3,884,161 | A | | 5/1975 | Ankerson | |
| 4,232,614 | A | * | 11/1980 | Fitch et al. | 110/235 |
| 4,429,643 | A | * | 2/1984 | Mulholland | 110/238 |
| 4,448,588 | A | * | 5/1984 | Cheng | 48/99 |
| 4,531,462 | A | | 7/1985 | Payne | |
| 4,659,340 | A | * | 4/1987 | Weaver | 48/76 |
| 4,848,249 | A | | 7/1989 | LePori et al. | |
| 4,882,903 | A | | 11/1989 | Lowry Jr. et al. | |
| 4,932,336 | A | * | 6/1990 | Srowig et al. | 110/346 |
| 5,040,972 | A | * | 8/1991 | Kleinhenz et al. | 432/72 |
| 5,138,957 | A | | 8/1992 | Morey et al. | |
| 6,120,567 | A | | 9/2000 | Cordell et al. | |

FOREIGN PATENT DOCUMENTS

| | | |
|---|---|---|
| DE | 197 31 010 A1 | 1/1999 |
| WO | WO 0071934 A1 | 11/2000 |

* cited by examiner

*Primary Examiner*—Kenneth Rinehart
(74) *Attorney, Agent, or Firm*—Ryan W. Dupuis; Adrian D. Buttison; Michael R. Williams

(57) ABSTRACT

A gasification system for producing useful energy from a source of biomass material includes a gasifier for partially combusting biomass material into gaseous fuel, a contained fuel preparation site for preparing biomass material to be delivered to the gasifier, a boiler for combusting gaseous fuel from the gasifier to produce useful energy, and an air delivery system for directing combustion air to at least one of the gasifier and the boiler from the contained fuel preparation site. This arrangement recovers energy normally lost to atmosphere in the form of exhaust from biomass drying facilities. Drawing combustion air from the contained fuel preparation site also permits the fuel preparation site to be maintained at a negative pressure in relation to atmosphere, therefore any odour that is produced from the preparation of the biomass at the site is contained within the closed air delivery system and used for primary combustion at the gasifier or at the boiler.

19 Claims, 5 Drawing Sheets

GASIFICATION SYSTEM

This application claims the benefit of Provisional Application No. 60/366,521, filed Mar. 25, 2002.

FIELD OF THE INVENTION

The present invention relates to a gasification system for producing combustible gases from biomass material for combustion in a boiler to produce useful energy from a source of biomass material.

BACKGROUND

Gasification is a known process whereby solid organic or biomass fuel is partially combusted to collect combustible gaseous fuels. Examples of various gasifiers for solid biomass fuels are found in U.S. Pat. No. 4,531,462 to Payne; U.S. Pat. No. 4,848,249 to Lepori et al; U.S. Pat. No. 5,138,957 to Morey et al and U.S. Pat. No. 6,120,567 to Cordell et al. None of these patents however describe suitably efficient means for preparing the biomass materials to be gasified. A common problem for instance, is that the biomass materials are not prepared in a sufficiently contained area to prevent discharging of odours into the surrounding environment. Further inefficiencies arise when the biomass material is not prepared, gasified and subsequently completely combusted in a single environment with appropriate feedback and interaction between the various stages of the process.

SUMMARY

According to the present invention there is provided a gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material;

a boiler for combusting gaseous fuel from the gasifier to produce useful energy; and an air delivery system for directing combustion air to at least one of the gasifier and the boiler from the contained fuel preparation site.

Drawing combustion air from the contained fuel preparation site recovers energy normally lost to atmosphere in the form of exhaust from biomass drying facilities. Furthermore, the air can be readily heated at a heat exchanger on the boiler exhaust so that less heat is lost to atmosphere when the air is recycled and the biomass material is closer to a point of combustion prior to gasification at the gasifier. Drawing combustion air from the contained fuel preparation site also permits the fuel preparation site to be maintained at a negative pressure in relation to atmosphere, therefore any odour that is produced from the preparation of the biomass at the site is contained within the closed air delivery system and used for primary combustion at the gasifier or at the boiler. This would be beneficial to industries which are geographically located in areas where odour may be an environmental issue.

The fuel preparation site preferably includes a dryer for optimising moisture content of the biomass material. The air delivery system in this instance may be arranged to draw combustion air directly from an exhaust of the dryer. Alternatively, the air delivery system may include a bypass duct for drawing air from the fuel preparation site surrounding the dryer if volume of exhaust from the dryer is insufficient when little air is required for drying.

The fuel preparation site may further include a water removal press and a waste water disposal system for disposing of excess water content in the biomass material. The waste water disposal system would typically comprise a conventional on site industrial lagoon for waste water.

Collectively, the fuel preparation site preferably includes a biomass material mixing facility for mixing different types of biomass source material depending upon heating value of each, a biomass material drying facility for optimising water content of the biomass material before introduction into the gasifier and a biomass material storage facility of already prepared biomass which is ready for use by the gasifier to keep up with demands of boiler use.

The air delivery system preferably directs combustion air to both the gasifier and the boiler. A blower may be provided for directing combustion air to each of the gasifier and the boiler. Additionally, a dampering control may be provided for dampering the combustion air directed to each of the gasifier and the boiler.

Preferably, the air directed to each of the gasifier and the boiler is automatically dampered responsive to demands of boiler use.

When there is provided a conveying system for conveying biomass material from the site to the gasifier, operation of the conveying system is preferably responsive to demands of boiler use.

In the described embodiment, the gasifier may comprise:

a combustion chamber;

a centrally located biomass feed chute having an auger for directing biomass into the combustion chamber from the feed chute;

a fuel bed surrounding the feed chute; and an ash removal system below the fuel bed for removal of combusted ash material.

The combustion chamber of the gasifier is preferably operated within a temperature range of 700 to 900 degrees Fahrenheit for optimum performance, however, operating temperatures of the combustion chamber in a range of 400 to 1200 degrees Fahrenheit would still be reasonably effective.

There may be provided an induced draft fan in communication with boiler exhaust for maintaining the boiler and gasifier at a negative pressure in relation to atmosphere. When blowers are provided for delivering combustion air to both the gasifier and boiler, a balanced draft operation of the boiler results.

BRIEF DESCRIPTION OF THE DRAWINGS

In the accompanying drawings, which illustrate an exemplary embodiment of the present invention.

DETAILED DESCRIPTION

Figure 1:
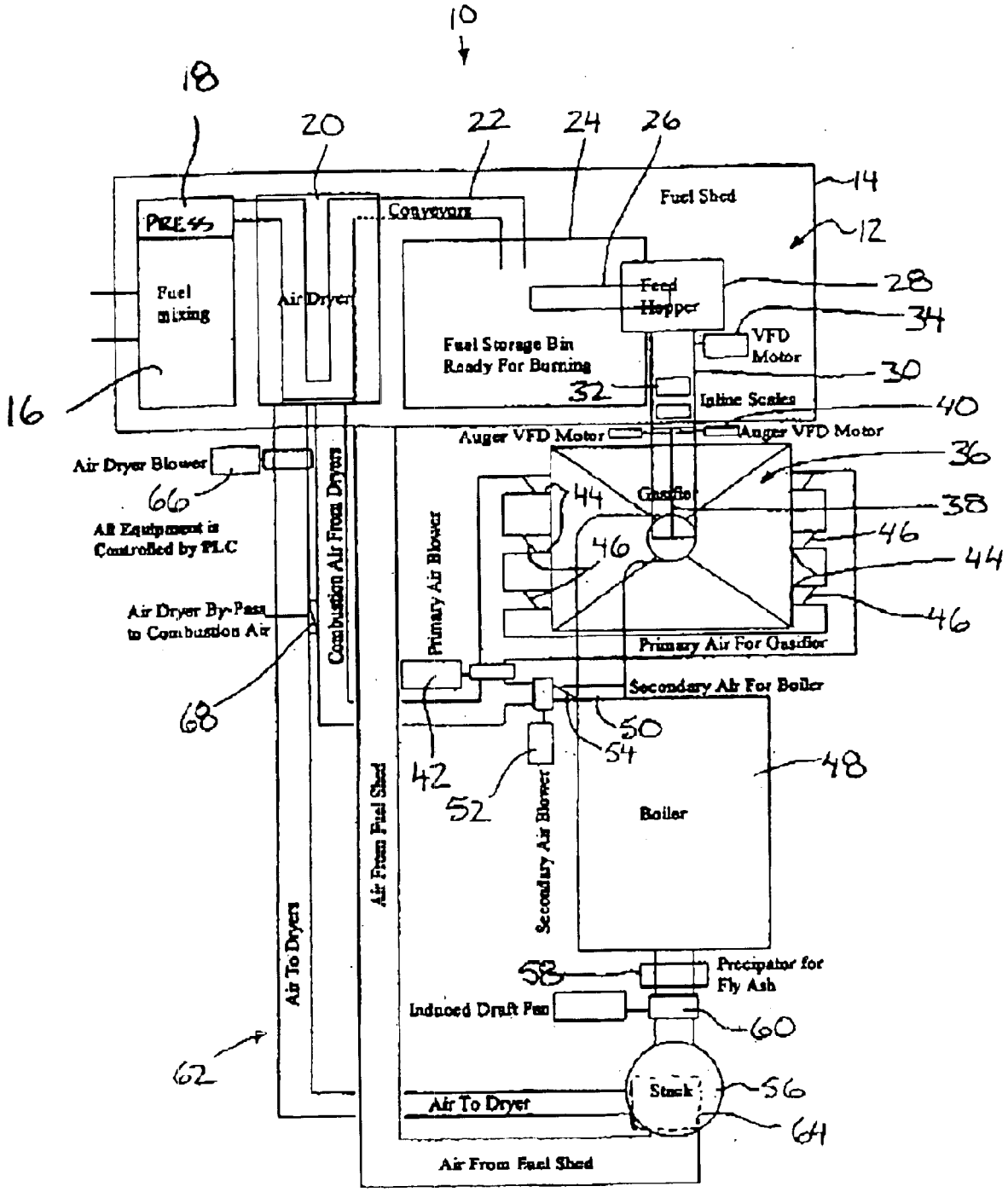
FIG. 1 is a schematic plan view of the gasification system.

Referring to the accompanying drawings, there is illustrated a gasification system generally indicated by reference numeral 10. The system 10 is particularly useful for producing useful energy on demand from a source of biomass waste material.

The gasification system 10 includes a fuel preparation site 12 which is contained within an enclosure 14 which is sealed from the surrounding atmosphere. The site 12 includes a mixing facility 16 arranged to receive one or more different types of biomass material and mix the material to have a consistent composition when exiting therefrom. The site further includes suitable presses 18 for removing excess water content from the biomass mixture and an air dryer 20 also for assisting in removing excess moisture.

The biomass mixture is displaced from the mixing facility 16 to the presses 18 and subsequently through the air dryer 20 by suitable conveyors 22. The conveyors deposit the prepared biomass mixture into a storage container 24. The storage container 24 includes an auger 26 for collecting the biomass mixture stored therein at a bottom of the container for subsequent delivery into a hopper 28 which dispenses a uniform amount of biomass mixture onto a suitable conveyor 30 incorporating inline scales 32.

The inline scales 32 are suitable arranged to determine the mass of biomass mixture per unit area being delivered by the conveyor 30. The conveyor 30 is controlled by a variable frequency drive (VFD) 34 which accordingly controls the rate at which the biomass mixture is dispensed from the storage container 24.

A gasifier 36 is provided which includes a pair of augers 38 arranged to receive biomass material from the conveyor 30 exiting the fuel preparation site 12 to a center of the gasifier 36 up through a side of the gasifier adjacent a bottom thereof. The augers 38 are similarly controlled by a variable frequency drive 40 for controlling the rate that the biomass mixture is delivered to the gasifier based on fuel demands of the system. A primary air blower 42 is provided for directing air to a plurality of combustion air inlets 44 spaced along opposing sides of the gasifier 36 adjacent a base thereof. The inlets 44 are each dampered by suitable dampers 46 which include respective controllers for automatically adjusting the position thereof in response to the fuel demands of the system. Exhaust in the form of combustible gaseous fuels exit from the gasifier for delivery to a boiler 48 of the system. The gasifier 36 will be described herein in greater detail further below.

The boiler 48 receives the gaseous fuel from the gasifier at an inlet 50 thereof at which point the gaseous fuel mixes with combustion air as it enters the boiler. The combustion air is supplied by a secondary blower 52 having an inlet damper 54 controlling the amount of air being directed into the boiler. The boiler is suitably arranged for spontaneous combustion of the gaseous fuel which is at elevated temperatures as it enters the boiler and mixes with the combustion air from the secondary blower.

The boiler is exhausted to a stack 56 after passing through a fly ash precipitator 58 for entrapping airborne ash. An induced draft fan 60 is provided between the boiler and the stack 56 for operation of the boiler and gasifier at a negative pressure in relation to atmosphere and for co-operation with the primary and secondary blowers for balanced draft operation of the boiler.

An air delivery system 62 is provided which draws air from the fuel preparation site 12. The site 12 is a contained area which is sealed with respect to the surrounding atmosphere and acts as the inlet air source for the air delivery system 62 which delivers combustion air to both the gasifier and boiler.

Air drawn from the site 12 is first passed through a heat exchanger 64 located at the stack 56 for being preheated by the boiler exhaust without mixing therebetween. Air from the heat exchanger 64 is drawn into the dryer 20 by a blower 66.

The air passing through the dryer collects moisture and some gaseous and particulate matter from the biomass mixture being prepared before being directed from the dryer exhaust to both the primary and secondary blowers 42 and 52. A bypass duct 68 is provided for communication between a duct exiting the heat exchanger 64 before entering the air dryer 20 and the duct connecting the dryer exhaust to the primary and secondary blowers. A damper is provided within the bypass duct to selectively open the bypass duct only in response to insufficient combustion air being provided to the primary and secondary blowers from the dryer so that air will be drawn directly from the fuel preparation site 12 surrounding the dryer, through the heat exchanger 64, instead of being passed through the dryer 20.

The gasification system 10, including all blowers, dampers, conveyors and augers, is controlled by a main controller 70 incorporating programmable logic controllers and sensors which measure operating conditions of the gasifier and boiler as well as stack emissions so that delivery of biomass through the system 10 is responsive to the boiler loading.

Figure 2:
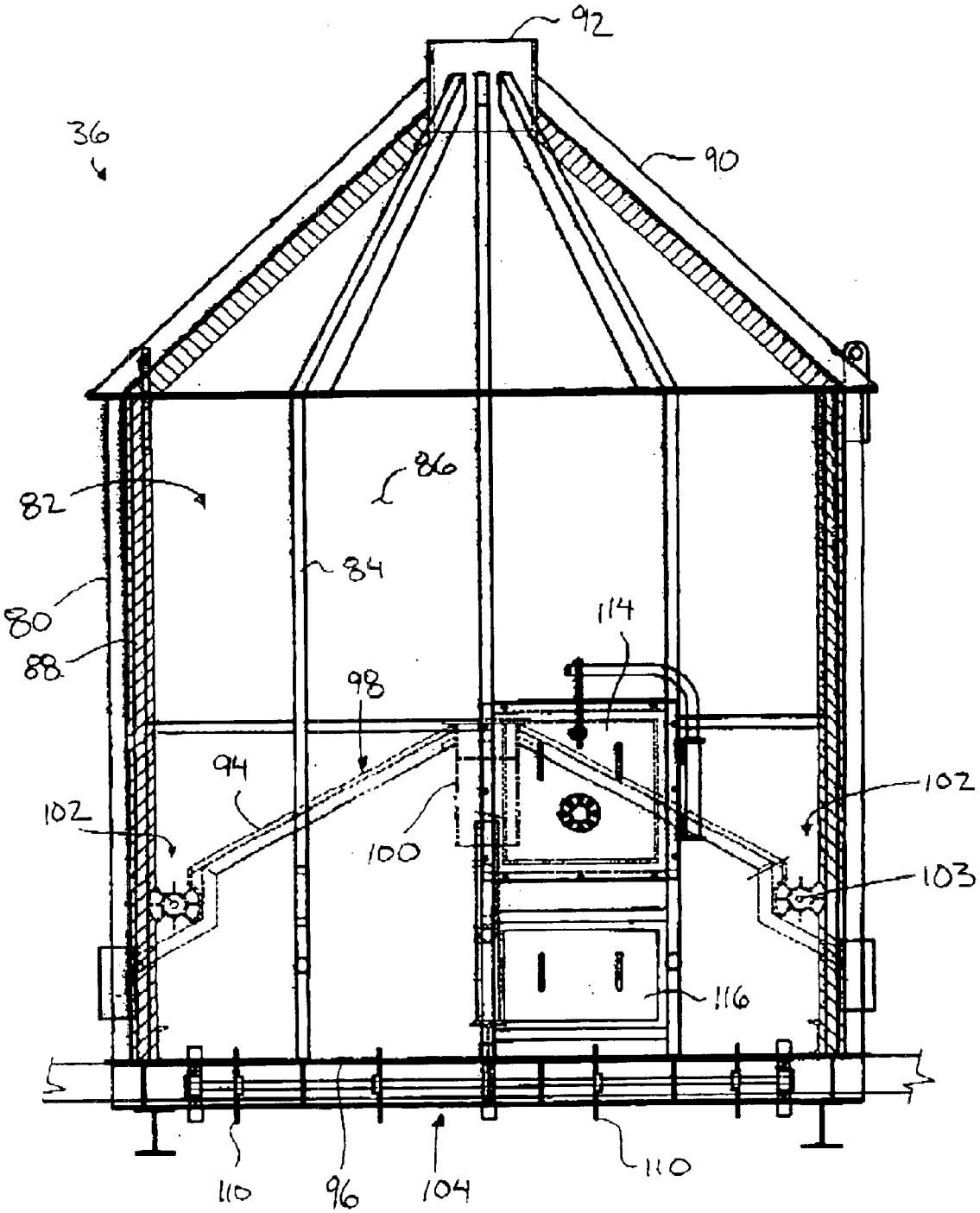
FIGS. 2 and 3 are front and side elevational views respectively of the gasifier with internal components of the gasifier shown in dotted line.
Figure 3:
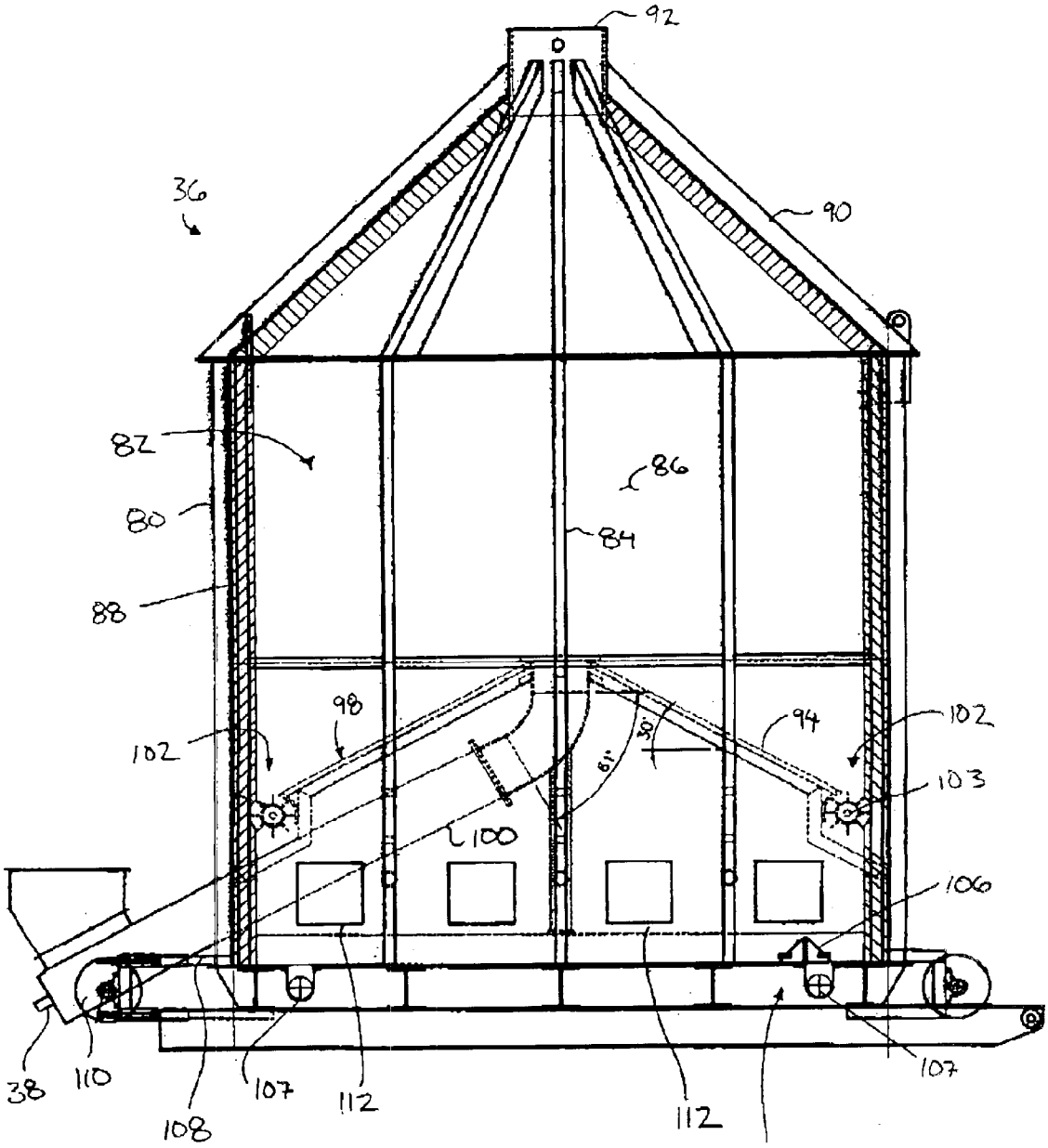
Figure 5:
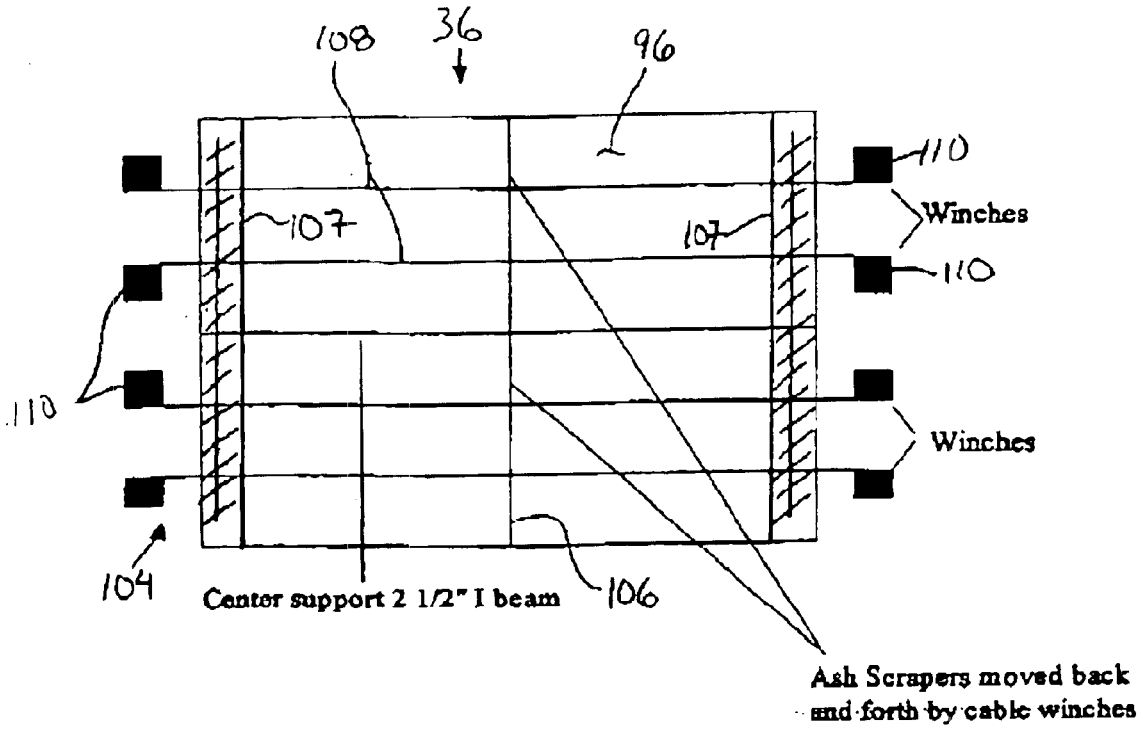
FIG. 5 is a top plan view of the ash removal system within the base of the gasifier.
Figure 4:
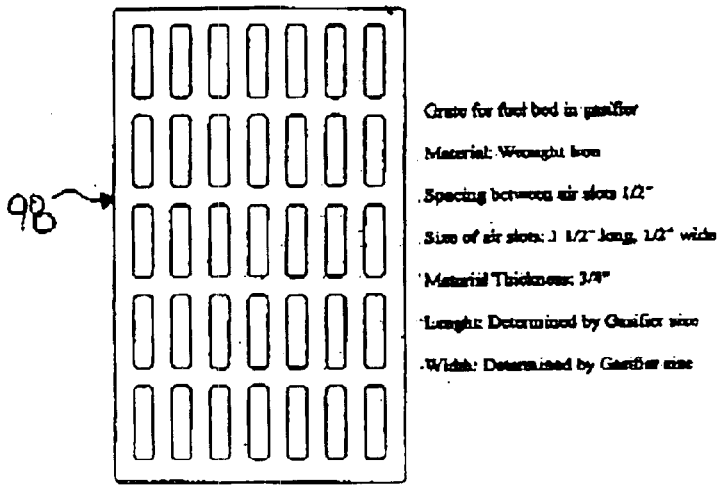
FIG. 4 is a plan view of one of the grates of the fuel bed of the gasifier.
Figure 6:
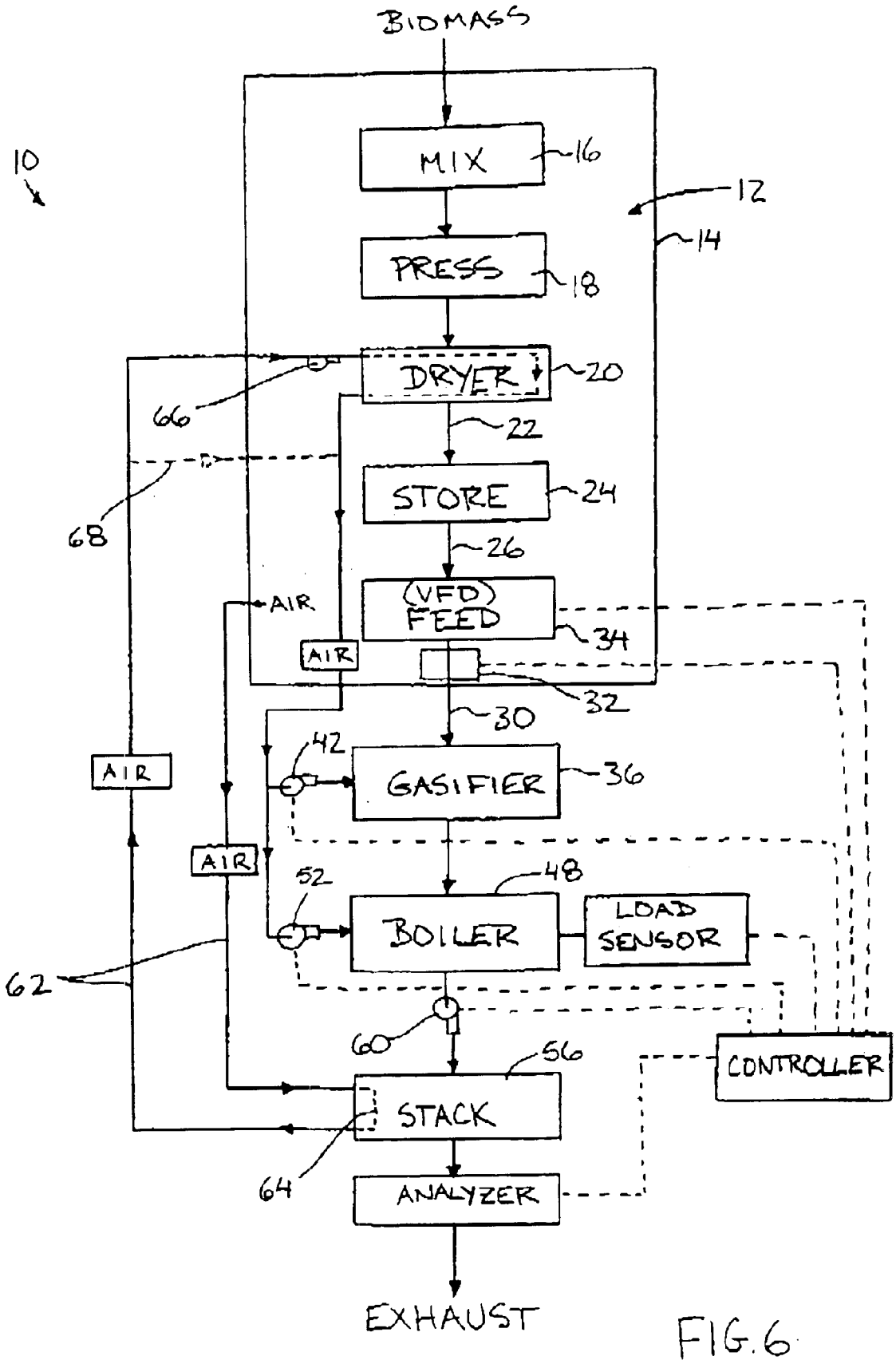
FIG. 6 is a flow diagram illustrating the order of operations of the gasification system.

Turning now to FIGS. 2 through 5, the gasifier 36 will now be described herein in further detail. The gasifier 36 generally comprises a rectangular housing 80 having a combustion chamber 82 therein. The walls of the housing are formed by beams 84 supporting plates 86 of material thereon while an interior of the combustion chamber 82 is lined with an insulating blanket of material 88. A top 90 of the gasifier has a generally pyramidal shape which tapers upwardly and centrally to an exhaust 92 from which the combustible gaseous fuels are exhausted to the boiler.

A fuel bed 94 is provided which is spaced upwardly from a bottom 96 of the housing 80. The fuel bed 94 generally comprises a plurality of grates 98 surrounding a feed chute 100 centrally located within the housing. The feed chute 100 includes the auger 38 therein for feeding biomass material into the combustion chamber of the gasifier. The feed chute extends upwardly and inwardly from one side of the gasifier housing adjacent a base thereof to a free end centrally located within the combustion chamber. The fuel bed 94 comprising the plurality of grates 98 surround the feed chute in a manner so as to span laterally outwardly and downwardly therefrom in a generally pyramidal shape.

An ash removal system 104 is located at the base of the gasifier housing below the fuel bed. The base of the gasifier housing generally comprises a flat bottom floor supported above a central beam upon which the ash removal system is supported. The ash removal system includes a scraper 106 in the form of an upright shovel blade which spans the full width of the gasifier centrally located therein but supported for lateral sliding movement across the floor from one wall to an opposing wall of the housing.

In operation, the grates 98 are arranged to dump the ash therethrough onto the floor of the gasifier housing. An ash cleanout trough 102 is provided along the intersection of the grates 98 with each of the four side walls of the gasifier housing. Each trough 102 is open along a top side to the fuel bed for receiving accumulated ash which has not fallen through the grates. The bottom side of each trough 102 is also open and communicates with the ash collection chamber below the fuel bed.

A rotatable member 103 is supported within each trough 102 which acts to meter the flow of ash through the respective trough 102. The rotatable member 103 generally comprises an axle extending the length of the trough 102 which includes a plurality of radially extending paddles mounted thereon to rotate with the axle. The paddles span the width of the trough to provide closure between the top and bottom sides of the trough when the rotatable member does not rotate. For removal of accumulated ash at the base of the grates 98 adjacent the respective walls of the housing, the rotatable members 103 within the respective ash cleanout troughs 102 are periodically rotated for collecting the accumulated ash above the fuel bed through the open top end and deposited the ash below the fuel bed through the open bottom end by action of the rotating paddles fixed on the rotatable members 103.

A pair of gutters 107 having augers for removal of ash therefrom are located parallel to one another in the floor below the fuel bed on opposing sides of the housing and parallel to the longitudinal direction of the scraper. A series of cables 108 and driven pulleys 110 are provided for displacing the scraper back and forth from one gutter to the opposing gutter so that the ash is displaced from the floor into the gutters 107 at which point augers within the gutters remove the ash from the gasifier.

Air is fed into the gasifier housing through a series of ports 112 which are spaced apart on opposing sides of the housing below the fuel bed which are dampered by the dampers 46 of the air delivery system. The walls of the housing also include a pair of access openings 114 on opposing sides having respective sealable doors thereon to permit visual inspection of the fuel bed when the access ports are opened. A further access port 116 is provided for communication with the interior of the gasifier housing below the fuel bed for inspection of the collected ash therebelow. The access port 116 similarly includes a sealable door for selectively closing the access port 116. The gasifier further includes a pressure relief (not shown) in communication with the combustion chamber to ensure any excess pressure within the combustion chamber which exceeds 5 psi is exhausted to the surrounding atmosphere within the contained fuel preparation site 12.

The gasification system will allow for the burning of any type of organic matter. This permits the use of waste products that have been found to be environmentally undesirable to be turned into useful energy while reducing the harmful affects to the environment. This process allows for the burning of such products as manure straws, flax chives and any other waste products that may be confirmed through testing to determine BTU content.

Typical reactions within the gasifier in operation include the Boudouard reaction ($CO_2+C=2CO-172.6$ MJ/kmol), the water-gas reaction ($C+H_2O=CO+H_2-131.4$ MJ/kmol), the water shift reaction ($CO_2+H_2=CO+H_2O+41.2$ MJ/kmol) and the methane production reaction ($C+2H_2=CH_4+75$ MJ/kmol).

A key component to the gasification system is the fuel preparation site 12 where all of the biomass fuel is received and processed before being introduced to the gasifier for combustion. The fuels are then combined to the desired mix for combustion. The mixture is processed according to the content of the fuel to ideally obtain 40% to 60% moisture, but 5% to 80% moisture content is still usable. This process may include steam press or dryers as determined by the components in the fuel mixture and the amount of moisture in the mixture which requires removal. The air used in the drying process is first preheated with the exhaust gas from the boilers.

The prepared fuel, once ready for the gasifier, is then fed onto the conveyors described above. The initial stage of the conveyor consists of the inline scale 32 which weighs the amount of fuel passing on the conveyor 30 at a fixed area and weight. Once the amount of fuel per unit area and the heating value of the mixture is known, then the amount of energy available may be determined. Once the amount of energy per unit area on the conveyor is known, the energy feed rate to the gasifier is controllable by use of the variable frequency drives on the conveyor. The speed at which the variable frequency drive is to operate is run in relationship to the boiler demands. This requires data input from sensors which determine the boiler loading. This data can be processed by analogue input from either a one, two or three element boiler system measuring feed water flow, drum level, steam flow from header, and header pressure drop. The relationship between the system steam load of the boiler, the conveyor speed and the rate of energy feed is then established.

The fuel preparation site 12 containing all of the equipment for fuel preparation is controlled in a slight negative pressure to that of atmosphere, in the order of −0.25 inches of water column. The use of an air handling unit with damper controls within the fuel preparation site will perform this function. The air supply will be pulled from an air pre-heater off the boiler stack and this air will be used for the fuel dryers first, then to the combustion header, the primary air for the gasifier and the secondary air for the boilers.

In this arrangement an air supply system is provided that pre-heats the air while the fuel preparation site is maintained at a negative pressure and useful air is provided for combustion. This is advantageous because drying of the fuel recovers energy which would have otherwise been lost to atmosphere and the prepared fuel retains heat which brings the fuel closer to the point of combustion prior to the gasification process. Also, the fuel preparation site under negative pressure ensures that any odour that is produced from the waste fuel mixture is contained within the air supply system and used for primary combustion. This is particularly of interest to industries which are geographically located in areas where odour may be an environmental issue. In this arrangement the rate of carbon monoxide and hydrogen gas fed to the boiler will depend upon the gasifier's burning rate which is controlled by the fuel feed rate from the fuel preparation site which has already been established as noted above.

Referring again to the gasifier 36, fuel is supplied to the gasifier by the screw auger to the center of the fuel bed within the housing. The pyramidal shape of the fuel bed permits the fuel mixture to cascade downwardly over the grates formed of pre-cast wrought iron plates having air slots therethrough at plural spaced locations to allow for the combustion air to be evenly distributed throughout the fuel bed. The outer plates or grates of the fuel bed base will be rocker plates to allow for the heavy ash to be dropped to the lower ash collection area where the ash will be augered out to an ash disposal area.

Combustion air to the gasifier is supplied from the fuel preparation site as described above, below the fuel bed so as to enter the combustion chamber through the air slots in the grates. With the moisture content of the fuel and the amount of air supplied at this stage of the process being controllable, the temperature of the burn can be controlled within an ideal range of 700° to 900° F. This temperature is critical for the production of gases to be supplied to the boiler. If the temperature starts to exceed 1200° F., there will not be enough carbon monoxide left in the gases produced by the gasifier for proper combustion within the boiler zone and the boiler will burn colder due to excess air, not producing the heat required. If the temperature reduces below 400° F., the burn will be too cold and will not burn all of the fuel properly which will produce unburned fuel in the waste ash.

The amount of fuel required for the load demand will be supplied by weight per BTU content. This is done by way of the inline scales 32. Dampers based on gas temperature will control the primary air supply to the combustion area. It is estimated that 40% of the secondary air in the boiler combustion process will come from the gasifier.

The gases produced by gasifier are routed to the throat of the boiler where secondary air is supplied and instantaneous combustion occurs. The amount of air required is determined in proportion to the primary air supplied to the gasifier and then trimmed by the stack gas analyser. The stack gas analyser is supported at the stack and provides continuous sampling of the gases exiting the stack. The controller subsequently adjusts operation of the system to ensure that appropriate amounts of oxygen are provided. When there is too much oxygen, the boiler cools down however, if there is not enough oxygen, combustibles will be released into the environment.

The steam pressure control at the boiler includes a steam header pressure control valve run from a downstream pressure transducer. This valve will either open or close to control the steam header pressure downstream of the valve. The boiler steam pressure will be set approximately one and a half times full system operating pressure. The transducer to control load demand shall be placed before the pressure valve but downstream of the boiler. The boiler steam pressure transducer will control the fuel feed rate to the gasifier unit. This transducer will control a variable frequency drive control on the feed conveyor system. The rate of speed will be determined by the steam load, Calorific values of the fuel by dry weight testing of the specific fuel mix being used for each unit location. The inline scales measure the weight of fuel being supplied to the gas fire unit.

The mixture of biomass fuels is to be determined previously by prior testing to find the BTU content of the specific measure. This mixture will then be passed through the presses and dryers to reduce moisture content ideally to between 40% and 60% of dry weight volume to control burn rate in the gasifier, but operably the moisture is reduced to between 5% and 80%.

The combustion air will be pulled from the fuel preparation site as described above. The boiler stack air pre-heater then pre-heats the air which can be directed to the fuel dryers or bypassed directly to the gasifier and boiler. Normally air from the dryers is directed proportionally to the gasifier and the boiler by way of the primary and secondary combustion air blowers. As noted previously the combustion air is drawn from the fuel preparation site (fuel shed) so as to maintain a slight negative pressure of −0.25 inches of Hg. This is to reduce offensive odour emissions. The air is then heated in the stack air heater to first supply hot air to the fuel dryers and secondly to improve combustion efficiency of the system.

After the air is heated and supplied to the fuel dryers, the air is used to dry the fuel to the desired dryness that is required for the gasifier combustion. The air is supplied to the dryers by the blower and air not required for the drying process is bypassed directly to the combustion air header. The air after leaving the dryers is then supplied to the combustion air header which supplies the gasifier and the boiler proportionally for the combustion process. Both the gasifier and the boiler have air blowers supplying the combustion air to them. The dampers which control the amount of air required for combustion are PLC controlled for the firing rate of the boiler. The boiler combustion air has a secondary control for the oxygen trim. This control function is to optimize the efficiency of the boiler as well as help in the control of the stack emissions.

Within the fuel preparation site, the biomass is first determined by what products are available in the immediate area, for example straw, flax, chives, mushroom manure, or cattle manure, etc. Once the fuel is determined, then depending on the type of fuel, it is to be mixed and processed ready for combustion. Processing is done by first mixing the fuel then either pressing or drying for removal of excess moisture at which point the dryers dry the mixture of biomass to between 5% and 80% moisture content by dry weight volume, or ideally between 40 and 60% moisture. After the fuel has been processed it is placed in the fuel supply storage bin. The storage area is to be sized for a one week supply of fuel to be calculated for boiler demand of the plant. The fuel is then conveyed as controlled by a variable frequency drive to a feed hopper. The drive for this conveyor is controlled by the inline scales that measure the feed rate of the fuel for the gasifier which is determined by boiler load/BTU content of the fuel. The augers which feed the biomass mixture to the gasifier are operated to match the feed rate of the feed conveyor by programmable logic controllers (PLC's).

The burning of the fuel in the gasifier is to be an incomplete burn to produce high levels of carbon monoxide. The gasifier is a unit designed to burn organic matter to a state of incomplete combustion so as to produce a high level of carbon monoxide in the gases. These gases are then supplied to a boiler as a fuel for combustion. The gasifier during firing will be kept at a pressure of approximately −0.25 inches of Hg as controlled by the induced draft fan for the boiler. The gasifier will produce gas for the boiler at a temperature between 400° F. and 1200° F. with optimum temperature being between 700° F. and 900° F. This temperature is controlled by the combustion air supplied to this part of the process and the moisture content of the fuel. These temperatures are critical for the performance of the boiler. When the temperature of the gases going to the boiler are too low, complete combustion within the boiler will not occur and heat will be lost with unburned gas being sent to the stack. When the gas is too hot there is too much combustion taking place in the gasifier and therefore the introduction of combustion air into the boiler will cool the gas, resulting in the loss of boiler efficiency as there will be not enough heat to keep up with the load demand.

The gas from the gasifier enters the boiler at the burner throat. The combustion air is introduced directly into the stream of gas at the throat. The introduction of air at this point will create spontaneous combustion of the gas in the boiler creating the heat required for boiler load demand. Sizing the boiler to be one and a half times the system load demand acts to buffer any instantaneous load demands in the system.

While one embodiment of the present invention has been described in the foregoing, it is to be understood that other embodiments are possible within the scope of the invention. The invention is to be considered limited solely by the scope of the appended claims.

What is claimed is:

1. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy;

an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler; and an induced draft fan in communication with boiler exhaust for maintaining the boiler and gasifier at a negative pressure in relation to atmosphere.

2. The gasification system according to claim 1 wherein the site includes a water removal press and a waste water disposal system for disposing of excess water content in the biomass material.

3. The gasification system according to claim 1 wherein the site includes a biomass material mixing facility and a biomass material storage facility.

4. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

the air delivery system being arranged to draw substantially all exhaust of the dryer as combustion air to said at least one of the gasifier and the boiler and the air delivery system including a bypass duct for drawing air surrounding the dryer in the site if exhaust from the dryer is insufficient.

5. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

wherein the site is maintained at a negative pressure in relation to atmosphere.

6. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

wherein the air delivery system preheats air from the site at the boiler before delivery of the combustion air to said at least one of the gasifier and the boiler.

7. A gasification system from producing useful energy source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

wherein the air delivery system directs combustion air to both the gasifier and the boiler.

8. The gasification system according to claim 7 wherein there is provided a blower for directing combustion air to each of the gasifier and the boiler and a dampering control for dampening the combustion air directed to each of the gasifier and the boiler.

9. The gasification system according to claim 8 wherein the air directed to each of the gasifier and the boiler is automatically dampered responsive to demands of boiler use.

10. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from en exhaust of the dryer before feeding the air to said at least one of the gasifier and the boiler;

wherein there is provided a conveying system for conveying biomass material from the site to the gasifier, operation of the conveying system being responsive to demands of boiler use.

11. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

wherein the gasifier comprises:

a combustion chamber;

a centrally located biomass feed chute having an auger for directing biomass into the combustion chamber from the feed chute;

a fuel bed surrounding the feed chute; and an ash removal system below the fuel bed for removal of combusted ash material.

12. The gasification system according to claim 11 wherein the combustion chamber of the gasifier is operated within a temperature range of 400 to 1200 degrees Fahrenheit.

13. The gasification system according to claim 11 wherein the combustion chamber of the gasifier is operated within a temperature range of 700 to 900 degrees Fahrenheit.

14. A gasification system for producing useful energy from a source of biomass material, the gasification system comprising:

a gasifier for partially combusting biomass material into gaseous fuel;

a contained fuel preparation site for preparing biomass material to be delivered to the gasifier from a source of biomass material, the site including a dryer for drying the biomass material to optimise moisture content of the biomass material;

a boiler for combusting gaseous fuel from the gasifier to produce useful energy; and an air delivery system for directing combustion air to at least one of the gasifier and the boiler from the contained fuel preparation site, the air delivery system being arranged to draw at least some of the combustion air directly from an exhaust of the dryer before feeding the air to said at least one of the gasifier and the boiler;

wherein the air delivery system is arranged to draw air into the dryer from the fuel preparation site surrounding the dryer prior to delivery of the air to said at least one of the gasifier and the boiler.

15. The gasification system according to claim 14 wherein the air delivery system includes a heat exchanger connected in series between the site and the dryer, the heat exchanger being supported in communication with exhaust from the boiler for preheating air drawn from the site and delivered to the dryer at the exhaust from the boiler.

16. A method of producing useful energy from biomass material, the method comprising:

mixing and storing the biomass material in a contained fuel preparation site;

drying the biomass material in a dryer within the contained fuel preparation site to optimise moisture content of the biomass material;

gasifying the biomass material after drying by partially combusting the biomass material into gaseous fuel;

combusting the gaseous fuel from the gasifier to produce useful energy in the form of heat; and directing combustion air to at least one of the gasifier and the boiler directly from an exhaust of the dryer for either gasifying the biomass material or combusting the gaseous fuel.

17. The method according to claim 16 including directing substantially all exhaust of the dryer as combustion air to said at least one of the gasifier and the boiler.

18. The method according to claim 16 including drawing air into the dryer from the fuel preparation site surrounding the dryer prior to delivery of the air to said at least one of the gasifier and the boiler.

19. The method according to claim 18 including preheating air drawn from the contained fuel preparation site and delivered to the dryer at a heat exchanger in communication with exhaust from the boiler.

* * * * *